US005158028A

United States Patent [19]

Beyer

[11] Patent Number: 5,158,028

[45] Date of Patent: Oct. 27, 1992

[54] MODULE WITH TUFTING TOOLS

[75] Inventor: Walter Beyer, Eschweiler, Fed. Rep. of Germany

[73] Assignee: Jos. Zimmermann GmbH & Co. KG, Fed. Rep. of Germany

[21] Appl. No.: 700,136

[22] PCT Filed: Nov. 6, 1989

[86] PCT No.: PCT/DE89/00700

§ 371 Date: May 23, 1991

§ 102(e) Date: May 23, 1991

[87] PCT Pub. No.: WO90/06391

PCT Pub. Date: Jun. 14, 1990

[30] Foreign Application Priority Data

Jan. 12, 1988 [DE] Fed. Rep. of Germany ... 8814944[U]

[51] Int. Cl.[5] ..... D05C 15/12

[52] U.S. Cl. ..... 112/80.45

[58] Field of Search ..... 112/80.4, 80.45, 222, 112/226; 26/86; 28/111, 115; 66/208; 83/660; 269/45, 53, 54.5, 95; 403/4, 380, 408.1

[56] References Cited

U.S. PATENT DOCUMENTS 4,138,956 2/1979 Parsons ..... 112/80.45 X
4,429,648 2/1984 Slattery ..... 112/80.45
4,489,475 12/1984 Struttman et al. .
4,574,716 3/1986 Czelusniak, Jr. ..... 112/80.45
4,637,329 1/1987 Czelusniak, Jr. ..... 112/80.45

FOREIGN PATENT DOCUMENTS 2828278 9/1985 Fed. Rep. of Germany ... 112/80.45
2055913 3/1981 United Kingdom .

*Primary Examiner*—Werner H. Schroeder
*Assistant Examiner*—Paul C. Lewis
*Attorney, Agent, or Firm*—Staas & Halsey

[57] ABSTRACT

A module with tufting tools, in particular needles, in which the tools (2) are cast in a basic body (1) the length of which is equal to a multiple of the mean distance between the tufting tools (2) cast into the basis body, is provided on its rear face (3), which can be attached to a bar, with a bearing ridge (5) and recesses and on its front face (4) with a receiving shoulder (7) and projections. The module is traversed lengthwise, from the rear face (3) to the front face (4), by an elongated hole (9). The recesses on the rear face (3) are formed by the spaces between a countersunk row (6), of teeth (10) which are identical and equidistant from each other and have straight flanks. The projections on the front side are formed by a projecting row of teeth (8), the teeth (12) and the spaces (13) between the teeth of the row of teeth (8) match the spaces (11) and the teeth (10), respectively, of the row of teeth (6).

8 Claims, 1 Drawing Sheet

FIG. 1
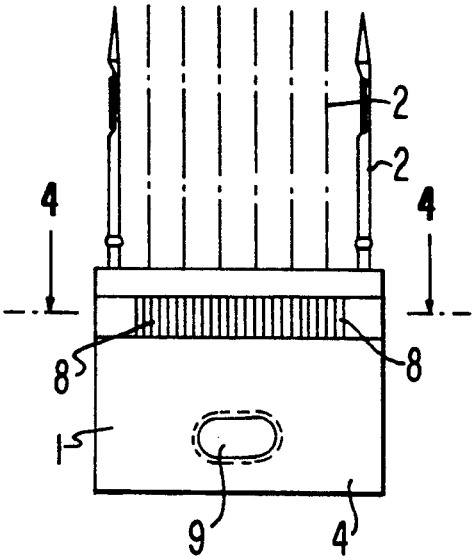
FIG. 2
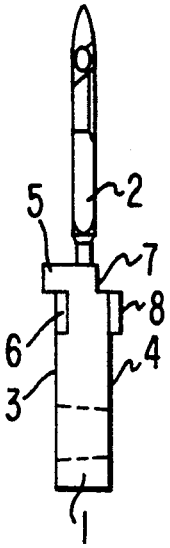
FIG. 3
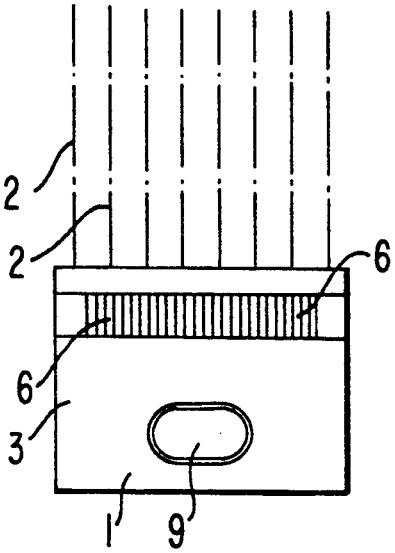
FIG. 4
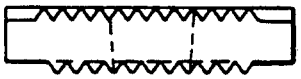
FIG. 5
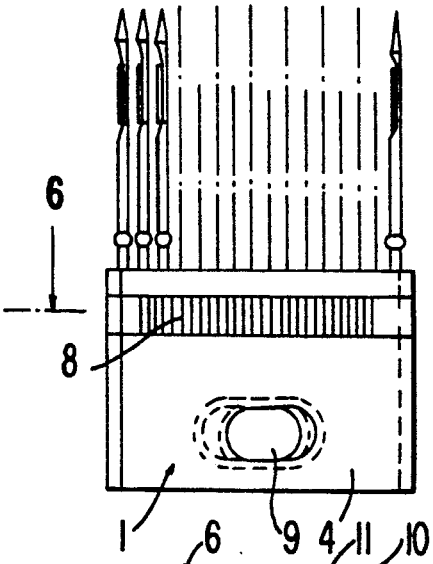
FIG. 6
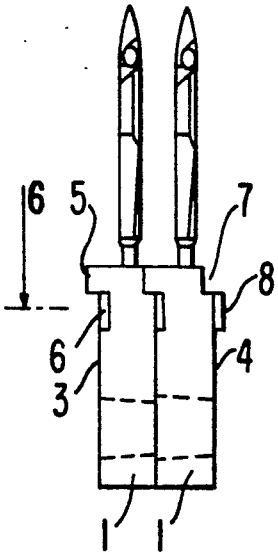
FIG. 7
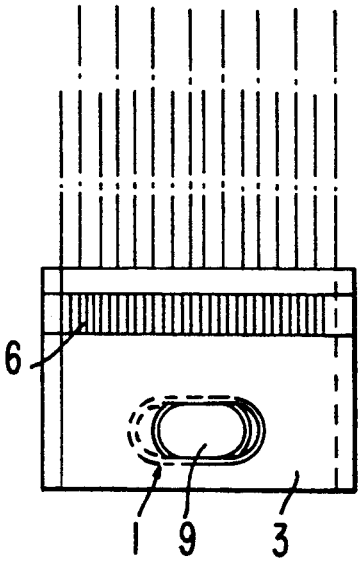
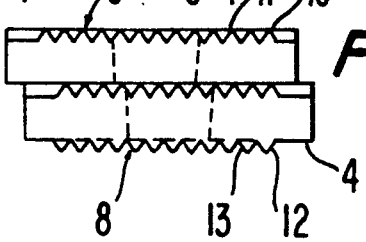
FIG. 8

MODULE WITH TUFTING TOOLS

SPECIFICATION

The invention relates to a module with tufting tools, in particular needles, in which the tufting tools are cast in a basic body, the length of which is equal to a multiple of the mean distance between the tufting tools cast into the basic body, which is provided on its rear face, which can be attached to a bar, with a bearing ridge and recesses and on its front face with a receiving shoulder and projections, and which has an elongated hole traversing the length of the module from the rear face to the front face.

Such a module for a tufting machine is known from DE-PS 2 828 278. In this case, the modules can be screwed on to a needle bar. Each basic body has two conical recesses arranged spaced lengthwise along the module on the rear face facing the needle bar. Correspondingly, two projections also arranged with a space between them are provided on the front face of the basic body. The recesses and the projections are dimensioned in such a way that the projection of one module can engage in the recesses of another when the two modules arranged nest to one another are offset against one another by half a needle division.

With the known module it is thus possible to create two rows of needles by forming two corresponding rows of modules, whereby the needles of one row are offset by half a division against those of the other.

During tufting operations a large number of deviating divisions of the tufting tools are used. In the case of the known module this leads to a separate basic body having to be produced for each division, in which the projection of the front face are to be arranged offset relative to the recesses of the rear face in accordance with the specific desired division.

The task of the present invention consists in avoiding this disadvantages of the known module. In particular, the invention aims to achieve a reduction in the number of necessary basic bodies which have to be designed differently without losing any of the precision of the modules to be joined together.

This task is solved in accordance with the invention by a module of the kind described at the beginning in that the recesses on the rear face are formed by the spaces between a countersunk row of teeth which are identical and equidistant from each other and have straight flanks, that the projections on the front side are formed by a projecting row of teeth, and that the teeth and the spaces between the teeth of the projecting row of teeth match the spaces and the teeth, respectively, of the countersunk row of teeth.

The countersunk row of teeth allows easy arrangement of the rear face of the module against a bar, e.g. a needle bar. The teeth of the projecting row of teeth on the front face of a module can easily be introduced into the spaces in the countersunk row of teeth of another module. Alignment takes place automatically in a lengthwise direction. It is possible to offset the connection between two such engaging modules by one further or several further teeth. Consequently, this makes it possible to modify the relative position of the tufting tools of adjacent rows in two or more stages.

The module in accordance with the invention can further be designed in such a way that the distance from center to center of the tufting tools represents the n-fold of the distance between the teeth, whereby n is a whole number $> 1$.

The module in accordance with the invention can further be designed in such a way that the spaces between the teeth of the countersunk row of teeth are offset against the teeth of the projecting row of teeth, whereby this offset measure is 1/n of the distance from centre to centre of the tufting tools and n is a whole number $>1$.

The module in accordance with the invention can further be designed in such a way that the division of the projecting row of teeth and the countersunk row of teeth is 5/64, 1/20 or 1/16 inch.

It is thus possible to form the countersunk row of teeth and the projecting row of teeth of the basic body with a division of 5/64 inch. The mould necessary for this basic body can then be used without any modifications to take tufting tools with a 5/64 or 5/32 or 5/16 division. When the tufting tools are cast they simply have to be placed in the mould of the basic body in accordance with the specified division. In this way, a substantial reduction in the number of moulds necessary for the production of the basic body is achieved.

The module in accordance with the invention can further be designed in such a way that the countersunk row of teeth is adjacent to the bearing ridge and the projecting row of teeth is adjacent to the receiving shoulder.

The bearing ridge and the receiving shoulder serve to simplify the alignment of the module at the bar or at the adjacent module row.

Finally, the module in accordance with the invention can be designed in such a way that the tooth flanks of each tooth form an angle of 35° to 50° with each other. Tests have shown that in this angle range of the teeth in particular, optimal engaging and, hence, alignment is achieved, whereby the force of pressure developing from the flank of one tooth is transmitted to that of the adjacent tooth. Removal from the mould becomes possible without any difficulty.

In the following part of the specification a practical embodiment of the module in accordance with the invention is described in conjunction with needles as tufting tools.

FIG. 1 shows a view of the front face of a module designed in accordance with the invention, FIG. 2 shows a left side view of the module in accordance with FIG. 1, FIG. 3 shows a view of the rear face of the module in accordance with FIG. 1, FIG. 4 shows a sectional view along the line 4—4 in FIG. 1, FIG. 5 shows a view of the front face of module designed in accordance with the invention as shown in FIG. 1 with a second module of the same design arranged behind it, FIG. 6 shows a left side view of one of the two modules in accordance with FIG. 5, FIG. 7 shows a view of the rear face of a module designed in accordance with the invention with a module of the same design arranged behind it, and FIG. 8 shows a section along the line 6—6 in FIG. 5.

The module shown in the figures has a basic body 1 into which are cast the pistons of tufting needles 2 arranged parallel and equidistant from one another. The basic body 1 has a rear face 3 and a front face 4 running parallel to it. The rear face 3 and the front face 4 run parallel with one another. A bearing ridges 5 projects from the rear face 3. A row of teeth 6 arrangd countersunk in the rear face 3 is adjacent to this bearing ridge 5.

On the front face 4 a receiving shoulder 7 is provided at the level of the bearing ridge 5. A row of teeth 8 projecting from the front face 4 is adjacent to this.

Furthermore, an elongated hole 9 is provided in the basic body which extends through the basic body 1 and the longer axis of which is aligned in the longitudinal direction of the module. The diameter of the elongated hole 9 is expanded from the front face 4 towards the rear face 3 to facilitate release from the mould.

The countersunk row of teeth 6 has teeth 10 arranged equidistant from each other and with straight flanks. The profile of the teeth 10 corresponds to the profile of the spaces 11 between the teeth 10.

The projecting row of teeth 8 on the front face 4 has teeth 12 and spaces 13 with a profile corresponding to that of the countersunk row of teeth 6. In the practical embodiment illustrated, one tooth 12 of the row of teeth 8 lies in each case opposite a space 11 of the row of teeth 6. The teeth 12 of the projecting row of teeth 8 can consequently be introduced into the spaces 11 of the countersunk row of teeth 6 of a further modules of the same design, whereby the front face 4 then comes to rest against the rear face 3. Two such modules joined next to one another can be joined in this way in several positions offset against one another lengthwise along the module.

FIGS. 5–8 show two modules joined in this way. In this position the bearing ridge 5 of one module lies on the receiving shoulder 7 of the other module, while the row of teeth 8 of one module engages in the row of teeth 6 of the other module. If the modules arranged next to one another in this way are offset in relation to one another in the longitudinal direction of the modules, then the elongated holes 9 are no longer precisely in line with each other, but instead each elongated hole projects beyond the other lengthwise. However, both elongated holes of the modules placed on top of one another leave a common passage free, through which a screw which is not illustrated can be passed to secure the modules to the bar.

The modules can be used to form a row of needles, and by placing two rows of modules next to one another to form two rows of needles, as well as to form three or four rows of needles. It is merely necessary to select the length of the elongated holes 9 according to the maximum offset dimension of the two modules lying on top of one another.

I claim:

1. A tufting tool module comprising:

an elongated body member having front and rear longitudinally extending surfaces and an edge face which extends longitudinally of said body and laterally between said surfaces;

a plurality of elongated parallel tufting tools extending outwardly from said edge face, said tufting tools being equally spaced apart longitudinally along said body member;

a plurality of recesses in said rear surface, said recesses being equally spaced apart a predetermined distance d and being arranged in a row thereof which extends longitudinally of said body member; and a plurality of projections extending outwardly from said front surface, said projections having shapes which are complementary relative to the shapes of said recesses, said projections being equally spaced apart said distance d and being arranged in a row thereof which extends longitudinally of said body member, said row of recesses and said row of projections being positioned so that the row of recesses on one said body member will mate complimentarily with the row of projections on another said body member in a plurality of longitudinally spaced positions.

2. A tufting tool modules as set forth in claim 1, wherein said row of recesses comprises the spaces between a countersunk row of identical teeth having straight flanks.

3. A tufting tool module as set forth in claim 1, wherein said row of projections comprises a projecting row of identical teeth having straight flanks.

4. A tufting tool module as set forth in claim 2, wherein said row of projections comprises a projecting row of identical teeth having straight flanks, said teeth of the projecting row each having a shape which is complementary to the shape of the spaces between the teeth of the countersunk row.

5. A tufting tool module as set forth in claim 1, wherein the spacing between adjacent tufting tools is equal to n·d, and wherein N is a whole number that is greater than 1.

6. A tufting tool module as set forth in claim 4, wherein the teeth of the projecting row are offset relative to the teeth of said countersunk row in a direction longitudinally of the body member by a distance d/2.

7. A tufting tool module as set forth in claim 4, wherein the spacing between adjacent tufting tools is equal to n·d, and wherein N is a whole number that is greater than 1.

8. A tufting tool module as set forth in claim 7, wherein the teeth of the projecting row are offset relative to the teeth of said countersunk row in a direction longitudinally of the body member by a distance d/2.

* * * * *